US007178704B2

(12) United States Patent
Saidman

(10) Patent No.: US 7,178,704 B2
(45) Date of Patent: Feb. 20, 2007

(54) ELECTRICALLY-OPERATED DISPENSER

(75) Inventor: Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 242 days.

(21) Appl. No.: 10/825,013

(22) Filed: Apr. 15, 2004

(65) Prior Publication Data

US 2005/0230438 A1 Oct. 20, 2005

(51) Int. Cl.
*B67D 3/00* (2006.01)

(52) U.S. Cl. ..... 222/504; 251/129.16; 251/129.09

(58) Field of Classification Search ..... 222/63, 222/504, 559; 251/129.09, 129.15, 129.16; 239/585, 585.3; 335/270, 266
See application file for complete search history.

(56) References Cited

U.S. PATENT DOCUMENTS

| | | | | |
|---|---|---|---|---|
| 1,790,271 | A * | 1/1931 | Kouyoumjian | 335/266 |
| 2,114,961 | A | 4/1938 | Gille | 137/139 |
| 2,491,905 | A | 12/1949 | Ray | 62/127 |
| 2,550,297 | A * | 4/1951 | Ray | 251/129.09 |
| 2,680,217 | A * | 6/1954 | Hussey | 335/270 |
| 2,850,685 | A * | 9/1958 | Ray | 335/270 |
| 2,873,069 | A * | 2/1959 | Matthews | 236/1 H |
| 3,212,715 | A | 10/1965 | Cocks | 239/125 |
| 3,243,013 | A * | 3/1966 | Molin et al. | 184/14 |
| 3,259,811 | A * | 7/1966 | Dunn | 335/270 |
| 3,329,347 | A | 7/1967 | Montgomery | 239/583 |
| 3,380,629 | A * | 4/1968 | Kontra et al. | 222/26 |
| 3,422,850 | A | 1/1969 | Caldwell | 137/625.65 |
| 3,485,417 | A | 12/1969 | Cocks | 222/146 |
| 3,531,080 | A | 9/1970 | Dillon | 251/129 |
| 3,704,833 | A | 12/1972 | Wheat | 239/585 |
| 3,732,893 | A | 5/1973 | Ziesche et al. | 137/625.65 |
| 3,833,015 | A | 9/1974 | Kneuer | 137/334 |
| 3,912,133 | A | 10/1975 | Hehl | 222/496 |
| 3,921,670 | A | 11/1975 | Clippard, Jr. et al. | 137/625.65 |
| 4,007,880 | A | 2/1977 | Hans et al. | 239/585 |
| 4,218,669 | A | 8/1980 | Hitchcock et al. | 335/258 |
| 4,295,631 | A | 10/1981 | Allen | 251/30 |
| 4,453,652 | A | 6/1984 | Merkel et al. | 222/504 |
| 4,474,332 | A | 10/1984 | Kaska | 239/585 |
| 4,531,679 | A | 7/1985 | Pagdin | 239/585 |
| 4,981,280 | A | 1/1991 | Brandenberg | 251/26 |
| 4,981,281 | A | 1/1991 | Brundage et al. | 251/30.02 |
| 5,005,803 | A | 4/1991 | Fritz et al. | 251/129.15 |
| 5,022,629 | A | 6/1991 | Tibbals, Jr. | 251/129.02 |
| 5,054,691 | A | 10/1991 | Huang et al. | 239/585 |

(Continued)

FOREIGN PATENT DOCUMENTS

| | | |
|---|---|---|
| WO | WO 97/38798 | 10/1997 |

*Primary Examiner*—Kevin Shaver
*Assistant Examiner*—Stephanie E. Tyler
(74) *Attorney, Agent, or Firm*—Wood, Herron & Evans, L.L.P.

(57) ABSTRACT

An electrically-operating liquid dispenser having an U-shaped pole. Windings of an electromagnetic coil are wound about the legs of the U-shaped pole and are energized selectively for moving an armature relative to the pole to open and close the dispenser. The U-shaped configuration of the pole conserves space within the dispenser and contributes to a narrow geometrical configuration for the dispenser, which allow more compact side-by-side arrangements of multiple dispensers. In certain embodiments, the windings may be divided into sets capable of being individually energized.

13 Claims, 6 Drawing Sheets

U.S. PATENT DOCUMENTS

| | | | | |
|---|---|---|---|---|
| 5,178,332 | A | 1/1993 | Tsukakoshi et al. | 239/552 |
| 5,192,936 | A | 3/1993 | Neff et al. | 335/281 |
| 5,375,738 | A | 12/1994 | Walsh et al. | 222/1 |
| 5,535,919 | A | 7/1996 | Ganzer et al. | 222/1 |
| 5,791,531 | A | 8/1998 | Hassler, Jr. | 222/504 |
| 5,794,825 | A | 8/1998 | Gordon et al. | 222/504 |
| 5,812,355 | A | 9/1998 | Nojima | 361/152 |
| 5,875,922 | A | 3/1999 | Chastine et al. | 222/1 |
| 6,305,583 | B1 | 10/2001 | Ward et al. | 222/504 |
| 6,318,599 | B2 | 11/2001 | Estelle et al. | 222/146.5 |
| 6,533,240 | B1 * | 3/2003 | Lotz | 251/129.15 |

* cited by examiner

ELECTRICALLY-OPERATED DISPENSER

FIELD OF THE INVENTION

This invention relates generally to liquid dispensers and, more particularly, to an electrically-operated dispensers for dispensing viscous liquids.

BACKGROUND OF THE INVENTION

Liquid guns, modules and dispensers are routinely used to dispense viscous liquids, such as hot melt adhesives, sealants and other thermoplastic materials, in a variety of dispensing applications employed in the manufacture of products and in product packaging. The flow and discharge of liquid in conventional liquid dispensers is regulated by either a pneumatically-actuated valve assembly or an electrically-operated valve assembly. Generally, valve assemblies of liquid dispensers feature a valve element movable for selectively contacting a valve seat to provide distinct opened and closed conditions that permit and interrupt, respectively, the flow of liquid to a dispensing orifice. Hence, cyclic movement between the opened and closed positions causes intermittent flow discontinuities required to generate a pattern of liquid on a surface of the product or product packaging.

Conventional electrically-operated liquid dispensers include a stationary pole, a movable armature coupled with the valve element, and an electromagnetic coil that causes the armature to move relative to the pole for providing the opened and closed conditions. The armature and pole are typically cylindrical components located inside the inner diameter of the solenoidal windings of the electromagnetic coil and that adjoin at an interface inside the inner diameter. As a result, the windings are constrained by, and must conform to, the circular cross-sectional profile of the armature and pole. The conventional arrangement of the pole, armature and electromagnetic coil inside the liquid dispenser does not make efficient use of the open space available inside the dispenser's body. As a result, the spacing between adjacent electrically-operated liquid dispensers cannot be sufficiently reduced, which is detrimental for some small footprint applications applying closely-spaced amounts of liquid on the surface of the product or product packaging. Changing the shape of the liquid dispenser's body from a cylindrical object to a parallelepiped may permit denser packing of adjacent dispensers. However, merely packaging the concentric pole and coil inside a rectangular or trapezoidal dispenser body does not cure the limitations for spacing adjacent conventional liquid dispensers as the cylindrical coil geometry provides a fundamental limitation on the shape and dimensions of the body.

Conventional electrically-operated liquid dispensers suffer from additional deficiencies. One such deficiency is the size of the armature, which is immersed in the dispensed fluid. The inertia and resistance supplied by the dispensed liquid that must be overcome to initiate and sustain movement increases commensurate with the increases in the size of the armature. The field lines cross an air gap present at an interface between confronting surfaces of the pole and the armature. In addition, the field lines must cross a side air gap between a sidewall of the armature and a surrounding magnetic member that guides the field lines into the sidewall of the armature. The additional magnetic member and this side air gap are necessary for creating a closed flux path. The existence of this side air gap increases the reluctance and, hence, reduces the magnetic efficiency of the liquid dispenser. Furthermore, the mass of armature is increased as the armature must be sized to permit a closed flux path that contains both the side air gap between the armature and the magnetic member and the air gap between the confronting surfaces of the pole and armature.

It would therefore be desirable to provide an electrically-operated liquid dispenser having a compact, space-efficient pole design that is likewise magnetically efficient.

SUMMARY OF THE INVENTION

The invention overcomes the foregoing and other shortcomings and drawbacks of liquid dispensers heretofore known. While the invention will be described in connection with certain embodiments, it will be understood that the invention is not limited to these embodiments. On the contrary, the invention includes all alternatives, modifications and equivalents as may be included within the spirit and scope of the invention.

In accordance with one embodiment of the invention, an electrically-operated liquid dispenser includes a module body, an armature, a generally U-shaped pole, and an electromagnetic coil. The pole has first and second arms each extending with a generally parallel and spaced-apart relationship toward the armature. The electromagnetic coil has windings wrapped about the first and second arms of the pole. The windings of the electromagnetic coil are selectively energized for generating an electromagnetic field capable of moving the armature relative to the pole between an opened position allowing liquid flow from a liquid outlet in the module body and a closed position preventing liquid flow from the liquid outlet.

In accordance with another aspect, a method of operating an electrically-operated dispenser is provided. The dispenser includes a pole, an armature and an electromagnetic coil with first and second sets of windings. The armature is positionable relative to the pole when current is selectively provided to the first and second sets of windings between an opened position allowing liquid flow from a liquid outlet and a closed position preventing liquid flow from the liquid outlet. The method comprises supplying a first current to the first set of windings and a second current to the second sets of windings effective to move the armature from the closed position to the opened position. Once in the opened position, the second current is discontinued to the second set of windings and a third current is supplied to the first set of windings effective to maintain the armature in the opened position.

The electrically-operated liquid dispenser of the invention is capable of operating at faster cycle rates and is more magnetically efficient than conventional electrically-operated liquid dispensers. In addition, the liquid dispenser is narrower than conventional electrically-operated liquid dispensers as the pole is flatter than conventional cylindrical poles. As a result, side-by-side arrangements of multiple dispensers of the invention is more compact. Moreover, individual sets of coil windings may be wrapped about one of the arms of the U-shaped pole and connected in parallel so that each set is powered individually. This may simplify coil driver design as the armature may be held in its open position by supplying a hold current to one set of windings and deenergizing the other set of windings. The use of a simplified coil driver design will permit the use of less expensive and more reliable control electronics. The elimination of side gaps increases magnetic efficiency. This may permit reductions in the size and mass of the armature, which may be beneficial for reducing the time required to close the dispensing valve and high frequency operation.

The above and other objects and advantages of the invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENTS

Figure 1:
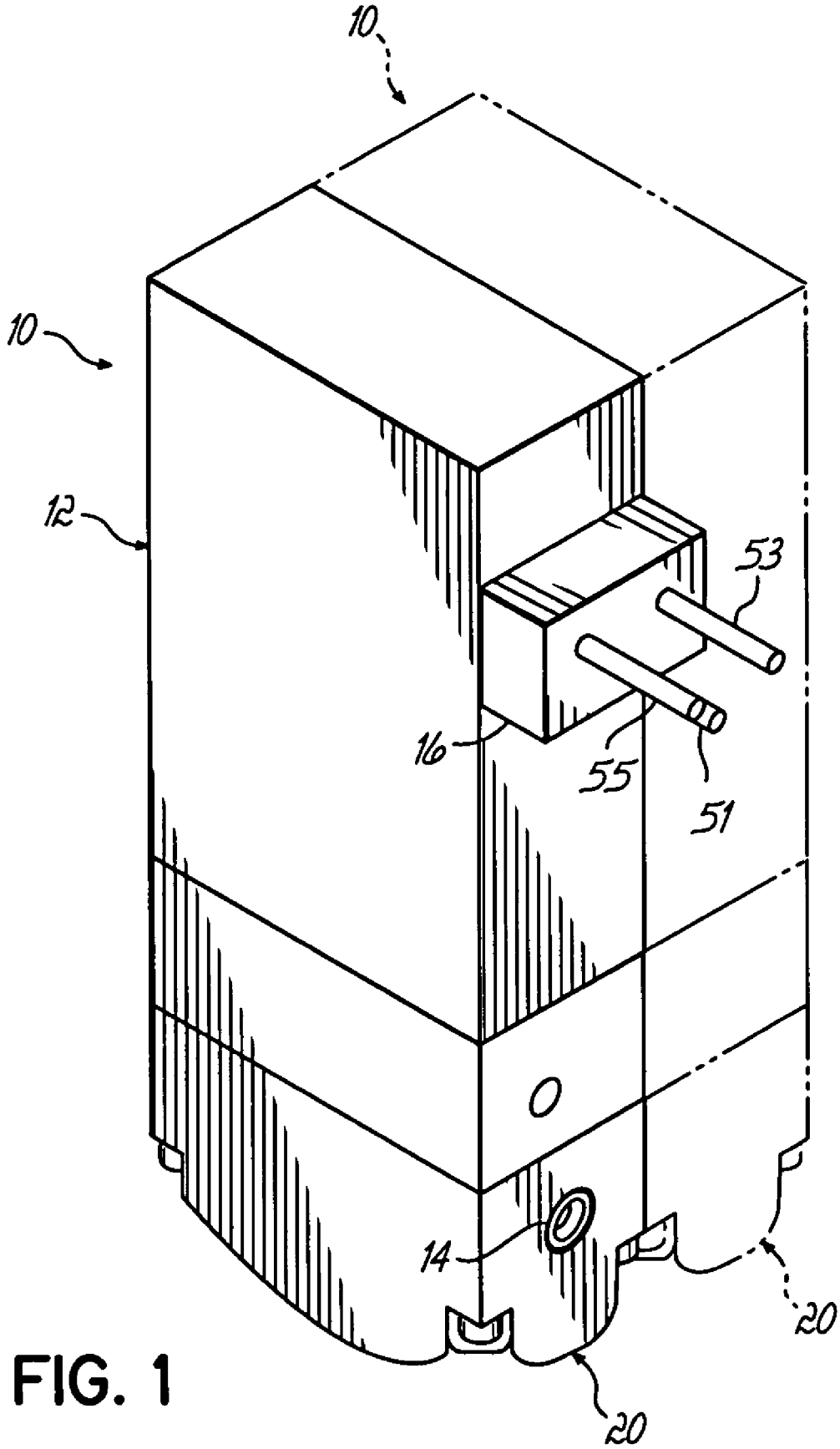
FIG. 1 is a perspective view of a dispenser in accordance with an embodiment of the invention.

With reference to FIGS. 1–4, an electrically-operated gun or dispenser 10 for intermittently dispensing viscous liquids includes a module body 12 with a liquid inlet 14 for admitting liquid supplied under pressure from a liquid supply (not shown) and an electrical connector 16 capable of being coupled with a suitable complementary electrical connector with a system controller 57 (FIG. 2) for energizing a field-generating electromagnetic coil 18 housed inside the module body 12. Dispenser 10 may be used to dispense ambient temperature viscous liquids, including cold adhesives or glues, and heated viscous liquids, such as hot melt adhesives. The dispenser 10 is mounted in a dispensing machine or system (not shown) in a known manner for intermittently dispensing viscous liquid in discrete volumes, such as beads or dots, to provide an interrupted, non-continuous pattern on a moving substrate. As shown in FIG. 1, multiple dispensers 10 may be positioned side-by-side in a row within the dispensing system. The compactness of the dispenser 10 and, in particular, the narrowness of the dispenser 10 due to the narrow pole design of the invention permits minimization of the spacing between adjacent dispensers 10.

References herein to terms such as "vertical", "horizontal", etc. are made by way of example, and not by way of limitation, to establish a frame of reference. It is understood various other frames of reference may be employed without departing from the spirit and scope of the invention. As is well known, liquid dispensers may be oriented in substantially any orientation, so use of these directional words should not be used to imply any particular absolute directions for an apparatus consistent with the invention.

Provided at one end of the module body 12 is a removably-mounted nozzle 20 including an orifice 22 defining a liquid discharge port of the dispenser 10. Nozzle 20 may be readily exchanged with other nozzles for varying the configuration of orifice 22 to dispense dots or beads of viscous liquid characterized by a different size and/or a different shape. Accordingly, nozzle 20 features a threaded engagement with the module body 12 to facilitate exchange.

The dispenser 10 further includes a stepped-diameter armature 24, a yoke-shaped or U-shaped pole 28 positioned in substantially centered alignment with the armature 24, and a pair of return springs 30, 31 that biases the armature 24 away from the pole 28. The armature 24 includes an end section 25 proximate to the pole 28, an integral valve stem 26 of lesser diameter than end section 25 extending axially from end section 25 toward the orifice 22, and integral outwardly-extending flanges 34, 35 extending in opposite transverse directions from end section 25. The return springs 30, 31 are each captured in a compressed state between a shoulder 32 defined inside the module body 12 and a corresponding one of a pair of flanges 34, 35. When the electromagnetic coil 18 is de-energized, the return springs 30, 31 collectively apply an axial force to the armature 24 that moves the armature 24 toward the orifice 22.

Figure 2:
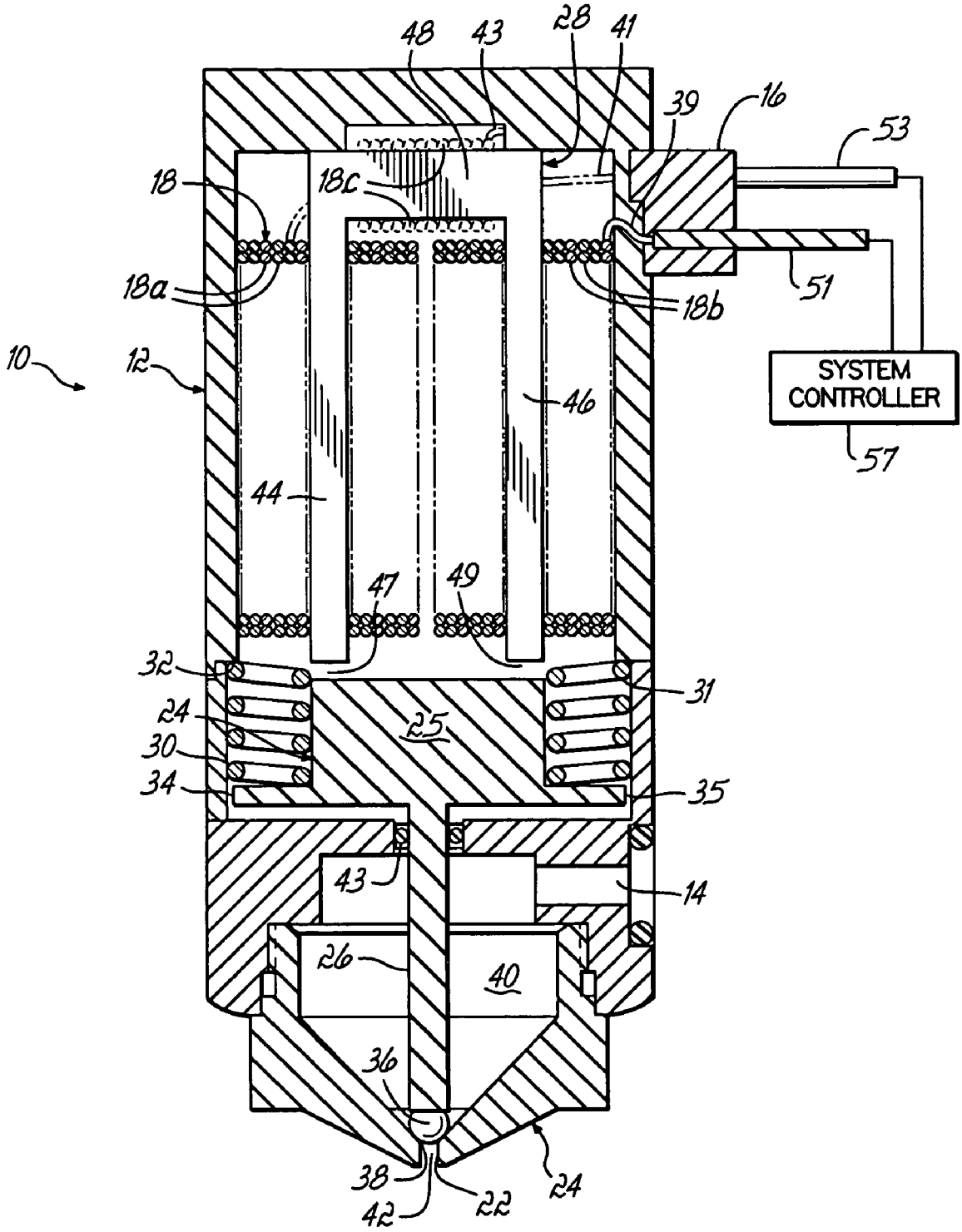
FIG. 2 is a cross-sectional view of the dispenser of FIG. 1 with the dispenser in a closed condition.
Figure 3:
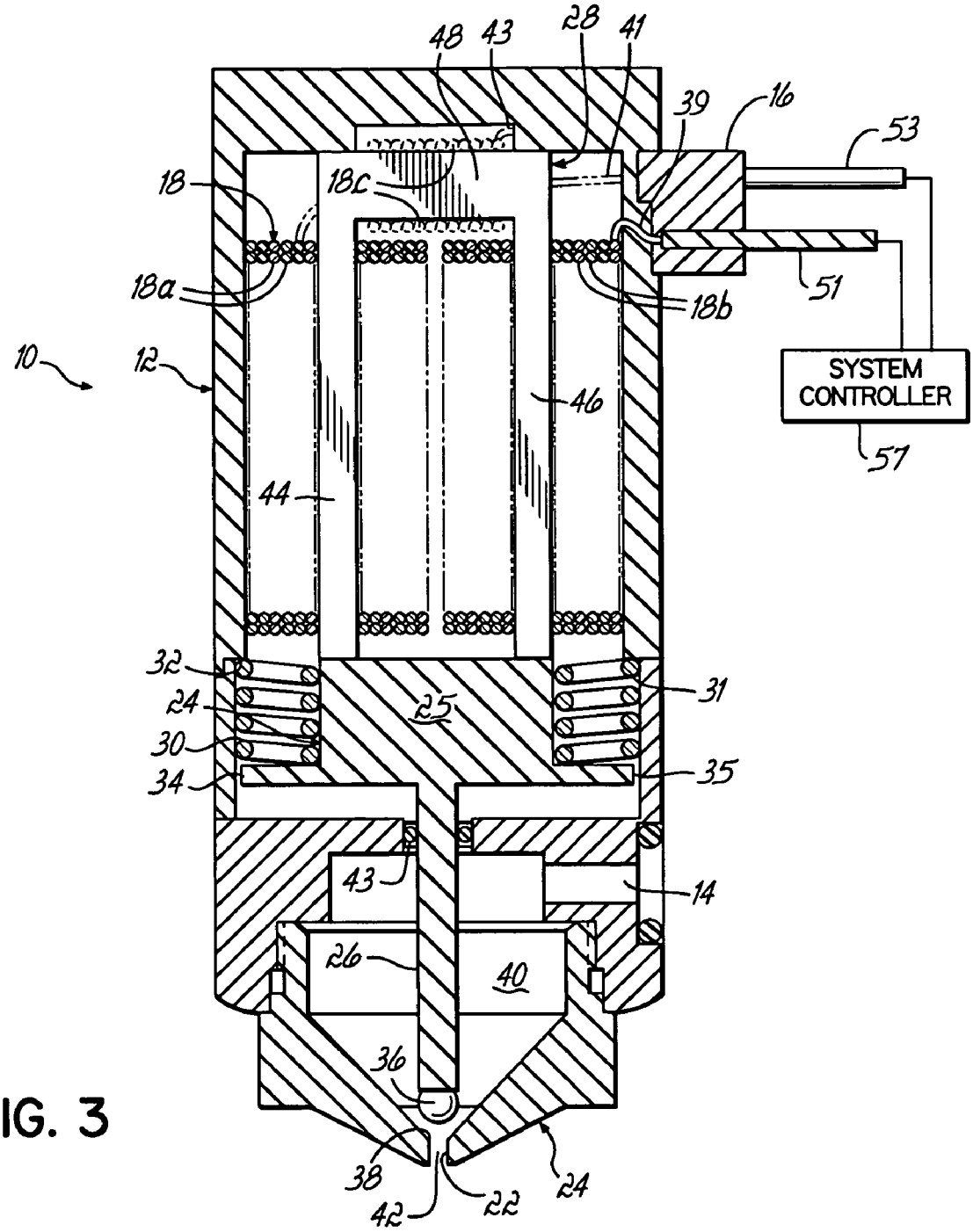
FIG. 3 is a cross-sectional view of the dispenser of FIG. 1 with the dispenser in an opened condition.

With continued reference to FIGS. 1–4, a valve element 36 at a free end of the valve stem 26 moves concurrently with the movement of the armature 24 and valve stem 26 as the electromagnetic coil 18 is energized and de-energized. The valve element 36, illustrated as having a spherical or hemispherical shape but not so limited in geometrical shape, is configured to engage a valve seat 38 formed in the nozzle 20 at an entrance to the orifice 22. When the valve stem 26 is moved to an opened position in which valve element 36 is spaced from the valve seat 38 as shown in FIG. 3, an annular gap is defined between the valve element 36 and valve seat 38. In this opened condition of the dispenser 10, liquid flows from a fluid chamber 40 defined inside the module body 12 and nozzle 20 through the annular gap into a liquid passageway 42 leading to the orifice 22. Viscous liquid dispensed in the fluid chamber 40 is replenished by a fresh supply of liquid flowing into the fluid chamber 40 by way of the liquid inlet 14. The inflowing viscous liquid also furnishes the pressurization of fluid chamber 40 that causes flow through the annular gap into liquid passageway 42. When the valve stem 26 is moved to a closed position, the valve element 36 contacts the valve seat 38 as shown in FIG. 2. In this closed condition of the dispenser 10, liquid filling the fluid chamber 40 is static and pressurized.

Provided inside of the module body 12 is a seal member 43 that furnishes a dynamic fluid seal about the exterior of the valve stem 26. This fluid seal isolates viscous liquid residing in fluid chamber 40 from electromagnetic coil 18 and pole 28 so as to prevent wetting. Seal member 43 may be, for example, a reciprocating seal such as those commercially available from Bal Seal Engineering Co. Inc. (Foothill Ranch, Calif.).

The pole 28 features a pair of arms 44, 46 that project axially from a joining or base section 48 with a generally parallel relationship towards the armature 24. The arms 44, 46 are arranged such that the pole 28 is generally inverted U-shaped. The U-shape of the pole 28 contributes to making the module body 12 of dispenser 10 compact and narrow, which permits minimization of the centerline spacing between adjacent dispensers 10. In particular, the module body 12 may have a compact rectangular or trapezoidal cross-sectional profile when viewed lengthwise parallel to the height of the dispenser 10.

The dispenser 10 assumes a closed condition when the electromagnetic coil 18 is deenergized by removing or reducing the delivered current. The dispenser 10 assumes an opened condition when the electromagnetic coil 18 is energized by sufficient current. The closed condition is characterized by a first armature position established by the return springs 30, 31 acting upon the armature 24. When the liquid dispenser 10 is in the closed condition, armature 24 is biased by the return springs 30, 31 toward the valve seat 38 so that arms 44 and 46 are separated from confronting areas of the end section 25 of armature 24 by gaps 47 and 49, respectively. The opened condition is characterized by a second armature position established by electromagnetic attraction of the armature 24 to the pole 28. When the liquid dispenser 10 is in the opened condition, armature 24 is biased by the return spring 30 toward the valve seat 38 so that arms 44 and 46 are separated from the end section 25 of armature 24 by gaps 47 and 49, respectively. The second armature position is maintained by continuously supplying a holding current to the electromagnetic coil 18 to generate an attractive force sufficient to resist the biasing of return springs 30, 31 that is acting in a direction to return the armature 24 to the first armature position.

Electromagnetic coil 18 includes one set of mutually-insulated windings 18*a* wrapped about arm 44 with a suitable toroidal winding pattern and another set of mutually-insulated windings 18*b* wrapped about arm 46 also with a suitable toroidal winding pattern. The windings 18*a,b* consist of multiple turns of an insulated conductor. The space separating arms 44, 46 is sufficient to introduce the windings 18*a,b* of electromagnetic coil 18. The windings 18*a,b* of the electromagnetic coil 18 are electrically coupled with the electrical connector 16 by conductors 39, 41, respectively. The invention contemplates that sets of windings 18*a* and 18*b* may each be wrapped about corresponding bobbins (not shown), which are then positioned as an assembly about the corresponding one of arms 44, 46. The invention contemplates that another set of windings 18*c* of electromagnetic coil 18, shown in phantom in FIG. 2, may be wrapped about the base 48 and electrically coupled with electrical connector 16 by a conductor 43.

With continued reference to FIGS. 1–4, the sets of windings 18*a,b* may be coupled in series and energized simultaneously for creating an electromagnetic field to move the armature 24 relative to pole 28. Pins 51 and 53 of electrical connector 16 are used to electrically couple windings 18*a,b* with a system controller 57 (FIG. 2). To that end, conductor 39 extends from windings 18*b* to pin 51 and conductor 41 extends from windings 18*a* to pin 53. Pin 55 of electrical connector 16 may supply a ground connection or, alternatively, be electrically coupled by conductor 43 with windings 18*c*, if present, for powering windings 18*c* from system controller 57. A multi-conductor cable terminated by a connector complementary to electrical connector 16 extends between the system controller 57 and the dispenser 10.

In an alternative embodiment, the individual sets of windings 18*a,b* may be coupled in parallel and independently energized by current delivered from system controller 57. For example, the current to windings 18*a* may be removed during a hold open phase while maintaining a constant current to windings 18*b* effective to maintain the armature 24 in the opened position. The capability of individually powering the sets of windings 18*a,b* simplifies the driver circuit design for the system controller 57 powering electromagnetic coil 18, as a reduced hold current to the coil may be provided by merely switching off one of the sets of windings 18*a,b*. Windings 18*c* may also be coupled in parallel along with windings 18*a,b* to system controller 57. In this alternative embodiment, the windings 18*a,b,c* may be energized in pairs or individually so that, for example, all windings 18*a,b,c* are energized to provide the opened condition and only windings 18*c* are energized to hold the armature 24 in the opened condition.

The system controller 57 includes a driver circuit of a known design with a power switching circuit providing output signals to the electromagnetic coil 18. The driver circuit is and normally comprises timing logic and a waveform generator that provides an input signal having a stepped waveform. The input signal is provided to a power switching circuit via an error amplifier. The power switching circuit is connected to a DC source and generates the output signal having a waveform corresponding to the input signal. A current sensor provides a feedback signal to the error amplifier. The system controller 57 includes other known dispensing system or machine controls (not shown) necessary for the operation of the dispenser 10, for example, a pattern control. The system controller 57 also includes input devices (not shown) such as a keypad, pushbuttons, etc. and output devices (not shown) such as a display, indicator lights, a relay, etc., that provide communication links with a user in a known manner.

The armature 24 and pole 28 are formed from any magnetic-flux-carrying material such as soft magnetic alloys including, but not limited to, ferritic chromium-iron stainless alloys. Suitable stainless alloys include Type 430F and Type 430FR stainless alloys, commercially available, for example, from Carpenter Technology (Reading, Pa.). Alternatively, the pole 28 may be formed from a stack of laminated layers or sheets for reducing the induction of eddy currents.

Figure 5:
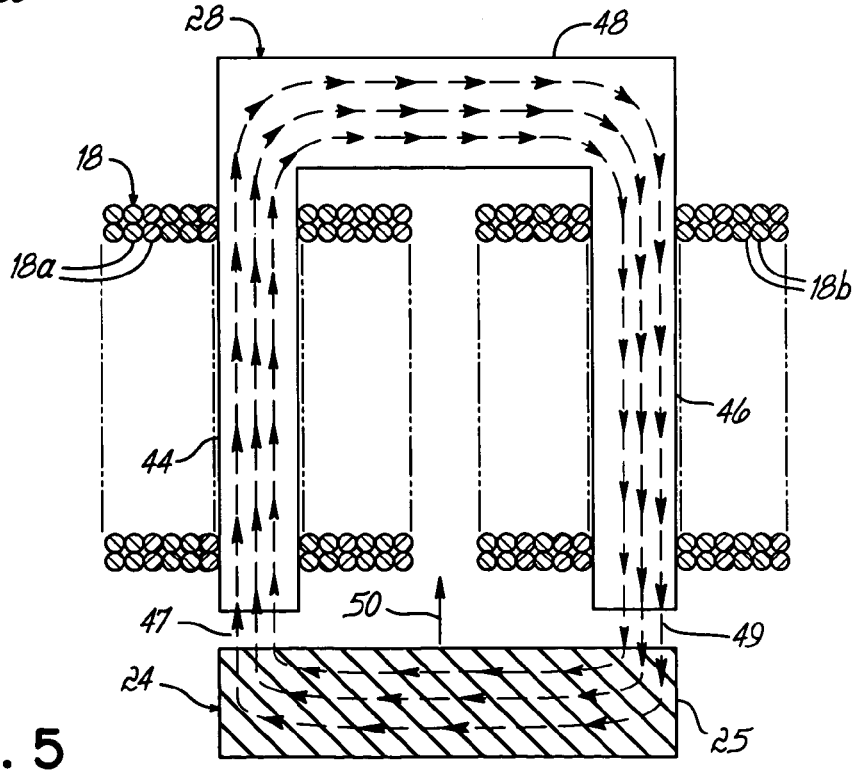
FIG. 5 is a diagrammatic view illustrating the magnetic flux lines in the armature and pole piece of the dispensers of the invention.

With reference to FIG. 5, when the electromagnetic coil 18 is energized, electrical current flowing through the sets of windings 18*a,b* produces an electromagnetic field. If the current is constant, the electromagnetic field is likewise constant and not time varying. The field lines of the electromagnetic field are confined to the armature 24 and pole 28. The field lines are confined to axial flux paths in the arms 44, 46 and radial flux paths in the base section 48 and the end section 25 of the armature 24. The field lines cross the gaps 47, 49 between the end section 25 and the arms 44, 46. Gaps 47 and 49 constitute the only gaps that the field lines must cross, which decreases the reluctance of the composite flux path and thereby increases magnetic efficiency. The electromagnetic field produces an unbalanced force effective to overcome inertia and displace the armature 24 toward the pole 28 in a direction shown by the arrow 50.

Figure 4:
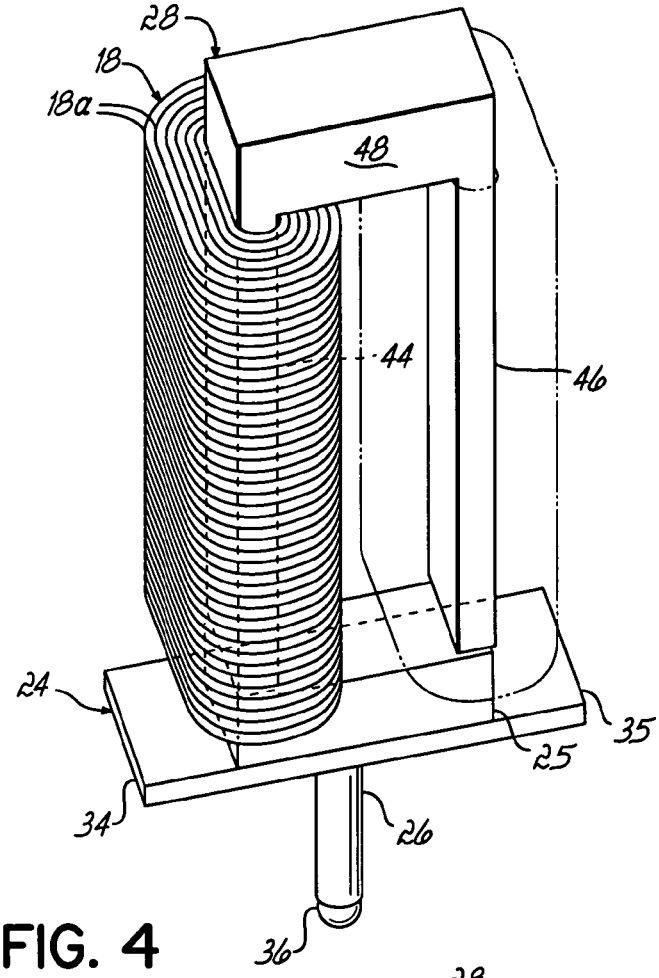
FIG. 4 is a perspective view of the armature and pole piece of the dispenser of FIG. 1.

Distributing the windings 18*a,b* about the two arms 44, 46 permits a more compact arrangement for the coil 18. Although the arms 44, 46 are depicted in FIG. 4 as having a rectangular or trapezoidal cross-sectional profile when viewed from a lengthwise perspective parallel to the height of the dispenser 10, the invention is not so limited as the individual arms 44, 46 may be square or even circular in cross-sectional profile. The side-by-side arrangement of the windings 18*a,b* facilitates a more compact arrangement for coil 18 and eliminates the ubiquitous side air gaps present in most conventional liquid dispensers. Fundamentally, the presence of two substantially parallel arms 44, 46 permits a relatively lengthy and narrow (i.e., compact) arrangement of the windings 18*a,b* of coil 18. For example, distributing the windings 18*a,b* over the two arms 44, 46 that are circular in cross-sectional profile defines a pattern for coil 18 that has one transverse dimension equal to sum of the radii of the windings 18*a,b* and a second orthogonal transverse dimension equal to the largest of the radii. If the radii are equal, the aspect ratio of the two transverse dimensions is 2:1. This leads to a reduction in one transverse dimension of the module body 12 relative to the other orthogonal transverse dimension of the module body 12, which makes the module body 12 thin and permits close side-by-side centerline spacings of adjacent dispensers 10 and hence closely-spaced dispensed amounts of viscous liquid dispensed from the adjacent dispensers 10.

In use and with reference to FIGS. 1–5, the armature 24 of dispenser 10 is moved between the opened and closed positions to interrupt the flow of liquid from the fluid chamber 40 to the orifice 22 for intermittently dispensing liquid. To initiate a dispensing cycle, a current pulse or spike at a peak current level is provided from the system controller 57 to the electromagnetic coil 18 during an initial turn-on period for a time effective to initiate movement of the armature 24. The resultant electromagnetic field supplied by the electromagnetic coil 18 induces an unbalanced attractive force between the armature 24 and the pole 28 sufficient to overcome the bias applied by return springs 30, 31. The armature 24 is displaced by the unbalanced attractive force toward the stationary pole 28 such that confronting surfaces of the armature 24 and pole 28 are either contacting or proximate to one another, which eliminates or minimizes gaps 47, 49. The movement of the armature 24 toward the pole 28 separates the valve element 36 from the valve seat 38 so that liquid flows from fluid chamber 40 through the annular gap therebetween into the liquid passageway 42 and out of orifice 22.

After the initial current pulse, the current supplied to the coil 18 may be reduced to a hold current level effective to maintain the armature 24 in the opened position for a desired on-time. The hold current maintains the armature 24 in the opened position in opposition to the biasing of return springs 30, 31 acting in a direction to return the armature 24 to the closed position. In alternative embodiments in which the windings 18*a,b* are connected in parallel with the system controller 57, the current to either windings 18*a* or windings 18*b* may be discontinued and the current to the other of windings 18*a* or 18*b* may be maintained at a hold current level effective to hold the armature 24 in its opened position against the opposing force of the return spring 30 for the desired on-time. Discontinuing the current supplied to one of the windings 18*a,b* maintains high performance while minimizing power dissipation in the electromagnetic coil 18. By reducing the current-induced heat load in the electromagnetic coil 18 in this manner, the coil 18 operates at a lower temperature. The output signal from the system controller 57 is maintained at the hold current level for the remaining portion of the on-time over which viscous liquid is dispensed. Reducing the current supplied to the electromagnetic coil 18 also effectively decreases the time required for the energy stored in the coil's 18 inductance to dissipate, thereby decreasing the turn-off time and the time required to close the dispenser 10.

To close the dispenser 10, the current supplied to the energized windings 18*a,b* is reduced to a current value smaller than the hold current. When the current to the electromagnetic coil 18 is reduced to effectively de-energize coil 18, the electromagnetic field dissipates and the attractive force acting between the armature 24 and pole 28 is removed. An unbalanced axial force exerted by the return springs 30, 31 displaces the armature 24 away from the stationary pole 28 until the valve element 36 contacts the valve seat 38. Contact between the valve element 36 and valve seat 38 discontinues flow from fluid chamber 40 into the liquid passageway 42 and thereby closes the dispenser 10. During the standby period of the operating cycle in which the dispenser 10 is closed, the current value may be substantially zero or some other value insufficient to energize the coil 18 above a threshold required to generate a sufficient electromagnetic field to cause movement of the armature 24.

Figure 6A:
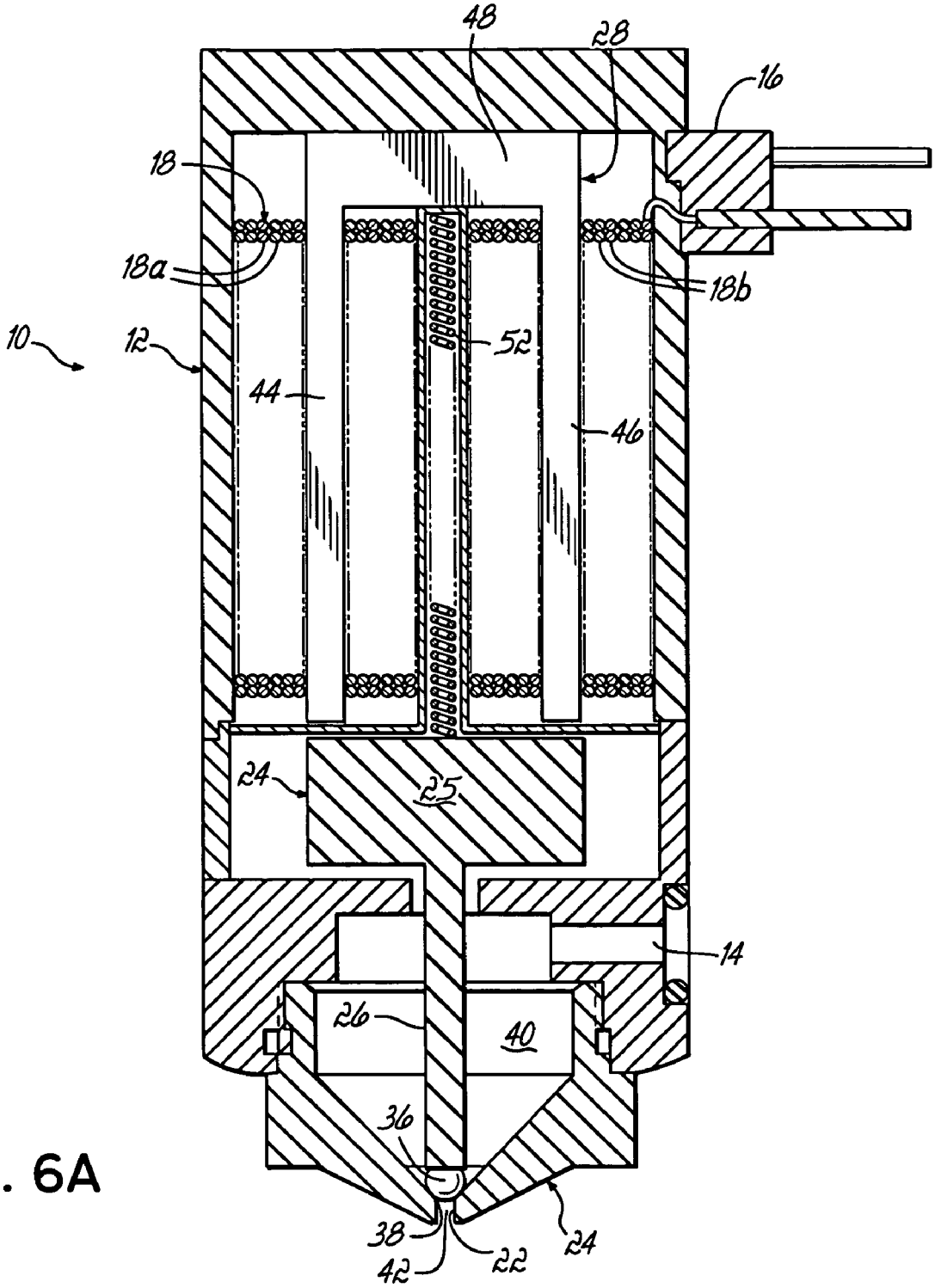
FIGS. 6A and 6B are cross-sectional views similar to FIG. 2 of dispensers in accordance with alternative embodiments of the invention.

With reference to FIG. 6A in which like reference numerals refer to like features in FIGS. 1–5 and in accordance with an alternative embodiment of the invention, a return spring 52 is substituted for return springs 30, 31 (FIG. 2). The return spring 52 is positioned in a rectangular cavity separating the sets of windings 18*a,b* and operates similar to return spring 30. The windings 18*a,b* are wound and dimensioned to provide a sufficient cavity therebetween for return spring 52 without interfering with the compression and extension of the coil turns of spring 52 as the dispenser 10 is opened and closed. Seal member 43 (FIG. 2) is omitted, such that viscous liquid from the enlarged fluid chamber 40 wets the end section 25 of armature 24 and the return spring 52. A housing 53, which has a central axial passage defining the space occupied by return spring 52, isolates the electromagnetic coil 18 and the pole 28 from the viscous liquid. The end section 25 of armature 24 may incorporate structure (not shown), such as radial grooves and flow passageways, to lessen the impact of viscous liquid positioned between housing 52 and armature 24 upon movement of armature 24 away from pole 28 when the coil 18 is deenergized.

Figure 6B:
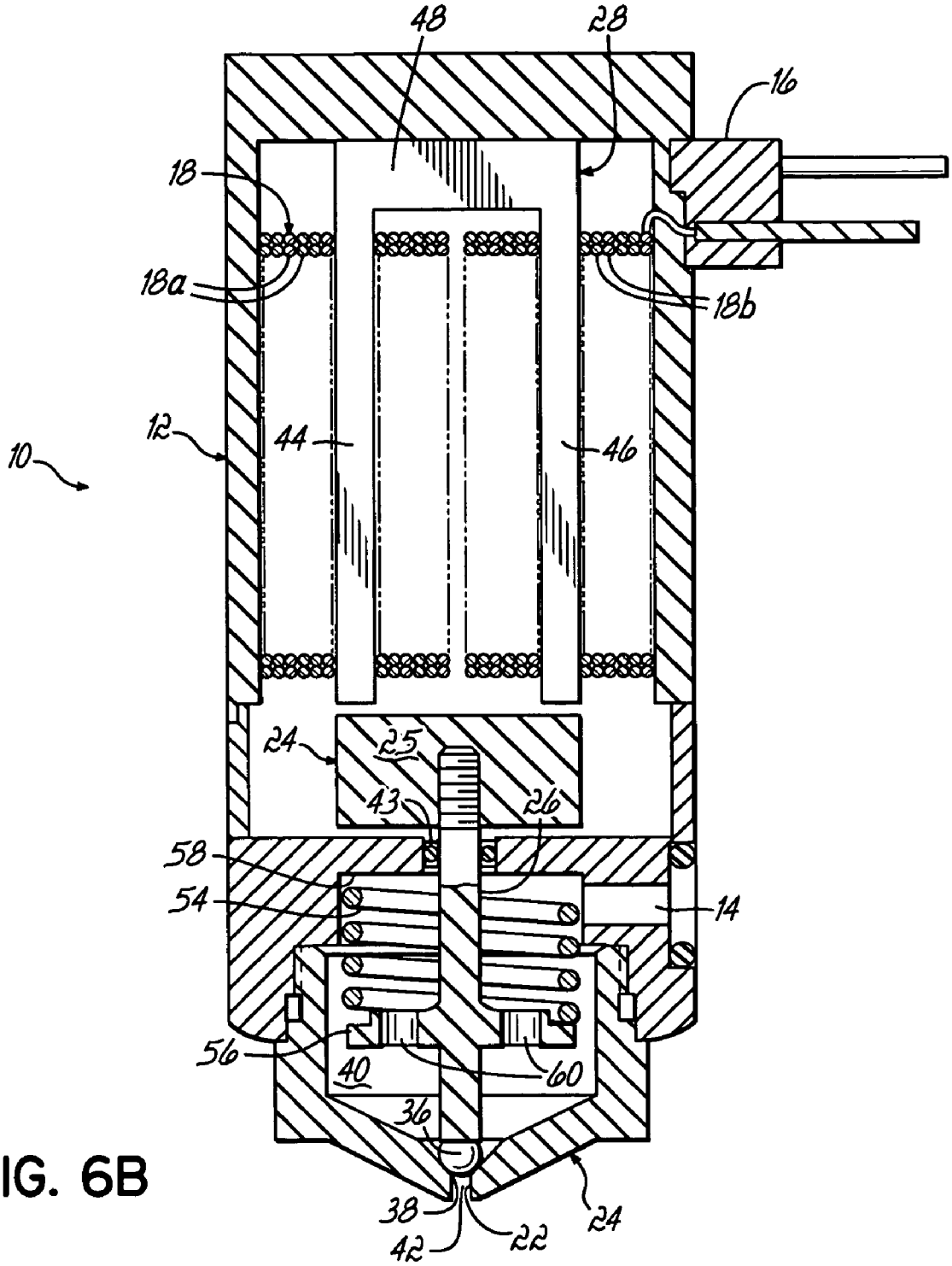

With reference to FIG. 6B in which like reference numerals refer to like features in FIGS. 1–5 and in accordance with an alternative embodiment of the invention, a return spring 54 is substituted for return springs 30, 31 (FIG. 2). The return spring 54 is captured between a vented spider 56 integral with the valve stem 26 and a shoulder 58 formed in the module body 10. The spider 56, which is positioned inside the fluid chamber 40, includes vent openings 60 that reduce the resistance to movement from the liquid filling the fluid chamber 40 as the armature 24 cyclically moves relative to the pole 28.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative methods, and illustrative examples shown and described. Accordingly, departures may be made from such details without departing from the spirit or scope of applicant's general inventive concept.

What is claimed is:

1. An electrically-operated dispenser for dispensing an adhesive, the electrically-operated dispenser comprising:

a module body having an adhesive inlet;

a nozzle coupled with the module body, said nozzle having an adhesive outlet and a valve seat between said adhesive inlet and said adhesive outlet;

an electromagnetic coil including a plurality of windings; and an armature disposed in said module body, and said armature including a valve element having an opened position allowing adhesive flow through an annular gap between said valve element and said valve seat to said adhesive outlet and a closed position in which said valve element contacts said valve seat for preventing adhesive flow to said adhesive outlet; and a generally U-shaped pole disposed in said module body, said pole having a fixed position relative to said module body, said pole having a first arm and a second arm extending with a generally parallel and spaced-apart relationship toward said armature, said plurality of windings being wrapped about substantially an entire length of said first arm and said second arm, and said plurality of windings of said electromagnetic coil being selectively energized for generating an electromagnetic field capable of moving said armature relative to said pole to move said valve element from said closed position to said opened position.

2. The electrically-operated dispenser of claim 1 further comprising:

a return spring biasing said armature axially away from said pole.

3. The electrically-operated dispenser of claim 2 wherein said first arm and said second arm define a cavity, said return spring being located in said cavity.

4. The electrically-operated dispenser of claim 1 wherein said plurality of windings are divided into a first set of windings wrapped about said first arm and a second set of windings wrapped about said second arm.

5. The electrically-operated dispenser of claim 4 wherein said first set of windings and said second set of windings are coupled in parallel so that said first set of windings is energizable independent of said second set of windings.

6. The electrically-operated dispenser of claim 4 wherein said first set of windings and said second set of windings are coupled in series so that said first set of windings is energizable simultaneously with said second set of windings.

7. The electrically-operated dispenser of claim 4 wherein said electromagnetic coil further comprises a third set of windings.

8. The electrically-operated dispenser of claim 7 wherein said third set of windings is coupled in parallel with at least one of said first set of windings and said second set of windings so that said third set of windings is energizable independent of at least one of said first set of windings and said second set of windings.

9. The electrically-operated dispenser of claim 7 wherein said third set of windings is coupled in series with at least one of said first set of windings and said second set of windings so that said third set of windings is energizable simultaneously with at least one of said first set of windings and said second set of windings.

10. The electrically-operated dispenser of claim 7 wherein said armature further comprises a base section joining said first and said second arms, said third set of windings being wrapped about said base section.

11. The electrically-operated dispenser of claim 4 wherein said first set of windings and said second set of windings have a side-by-side arrangement.

12. The electrically-operated dispenser of claim 1 wherein said first and said second arms are separated by a gap from said armature in at least said closed position.

13. The electrically-operated dispenser of claim 1 wherein said pole further comprises a base section joining said first and said second arms, and said windings of said electromagnetic coil are partially wrapped about said base section.

* * * * *